United States Patent [19]

Pearson

[11] Patent Number: 4,489,814

[45] Date of Patent: Dec. 25, 1984

[54] HAND BRAKE ARRANGEMENT

[75] Inventor: Arthur C. Pearson, St. Charles, Mo.

[73] Assignee: ACF Industries, Incorporated, New York, N.Y.

[21] Appl. No.: 404,120

[22] Filed: Aug. 2, 1982

[51] Int. Cl.[3] ..... B61H 13/26; B61H 13/02

[52] U.S. Cl. ..... 188/33; 74/501 R; 105/3; 105/4 R; 188/47

[58] Field of Search ..... 188/33, 34, 47, 56; 74/491, 505, 501 R; 105/3, 4 R, 4 A

[56] References Cited

U.S. PATENT DOCUMENTS

| | | | |
|---|---|---|---|
| 1,177,618 | 4/1916 | Gregg | 188/47 |
| 2,123,423 | 7/1938 | Kellett, Jr. | 188/34 |
| 3,712,146 | 1/1973 | Sands | 188/33 |
| 4,346,790 | 8/1982 | Morrison et al. | 188/34 |
| 4,422,532 | 12/1983 | Cardani et al. | 188/47 |

*Primary Examiner*—Duane A. Reger
*Assistant Examiner*—Robert J. Oberleitner
*Attorney, Agent, or Firm*—H. W. Cummings; E. N. Riddle

[57] ABSTRACT

In accordance with the present invention, a hand brake assembly (300) is mounted adjacent one end of a first car or articulated unit (303). A force dividing assembly (306) is provided on the first car, which divides the applied hand brake into a first (313) and second (321) hand brake linkages. The first hand brake linkage (313) is connected to a first air brake linkage (315) located on the first car. Preferably a portion of the first air brake linkage is located within an air brake cylinder (318). When the hand brake is applied, the first hand brake linkage (313) is effective to apply the brakes on the first car or unit through the first air brake linkage. The second hand brake linkage (321) extends from one car or unit to a second adjacent car or unit (333). A force multiplying assembly (324) is provided on the second car or unit which increases the hand brake force of the second hand brake linkage to a level sufficient to apply the brakes on the second car or unit through a second air brake linkage (336) located on the second car or unit. A second force dividing assembly (340) is located on the second car and another hand brake linkage (353) is connected thereto extend to a third car or unit 363 to apply the hand brake force on the third car or unit.

28 Claims, 31 Drawing Figures

HAND BRAKE ARRANGEMENT

IN THE DRAWINGS

Figure 1:
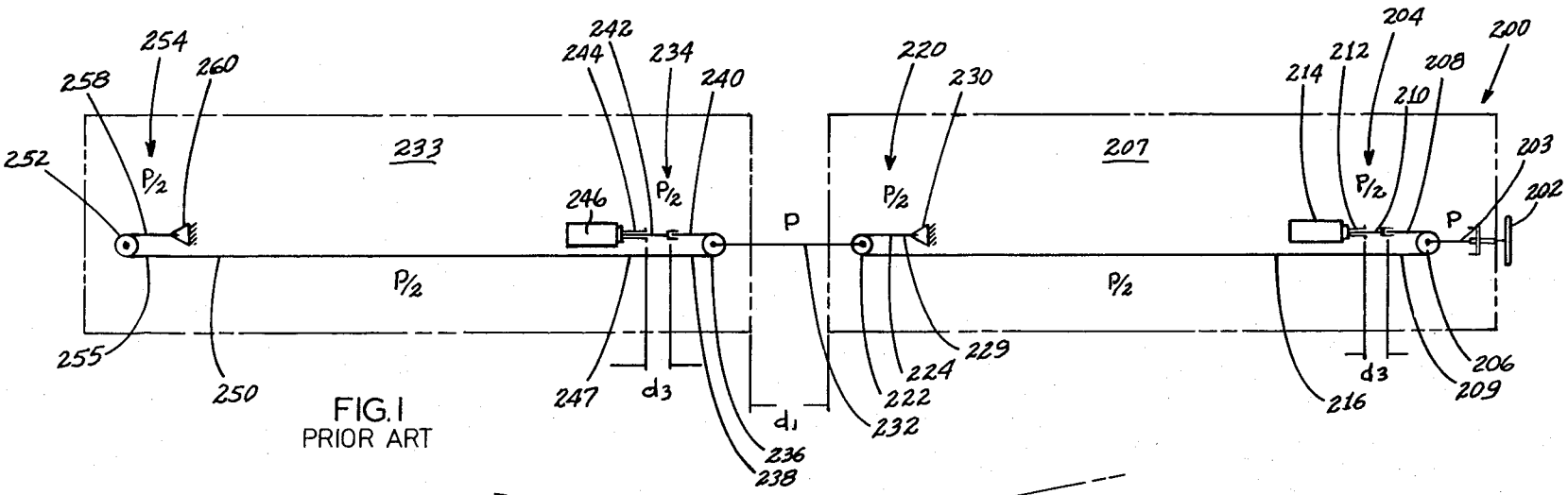
FIG. 1 PRIOR ART
FIG. 1 is a schematic view of a proposed prior art hand brake application arrangement, and indicating the distance between adjacent railcars as D1.
Figure 1A:
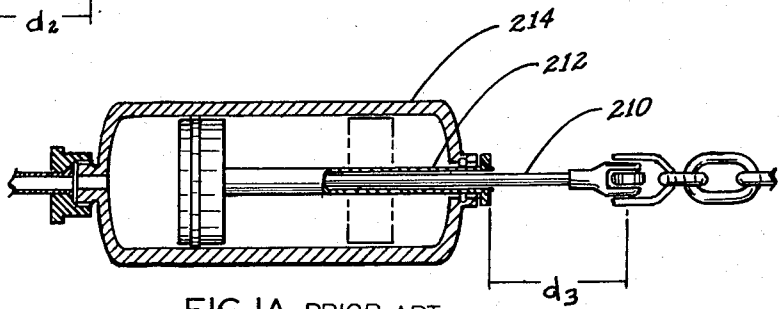
FIG. 1A PRIOR ART

FIG. 1*a* is a vertical sectional view illustrating a brake cylinder, brake piston, and indicating the distance that a brake push rod moves when curves are traversed in the hand brake arrangement indicated in FIG. 1.

Figure 3:
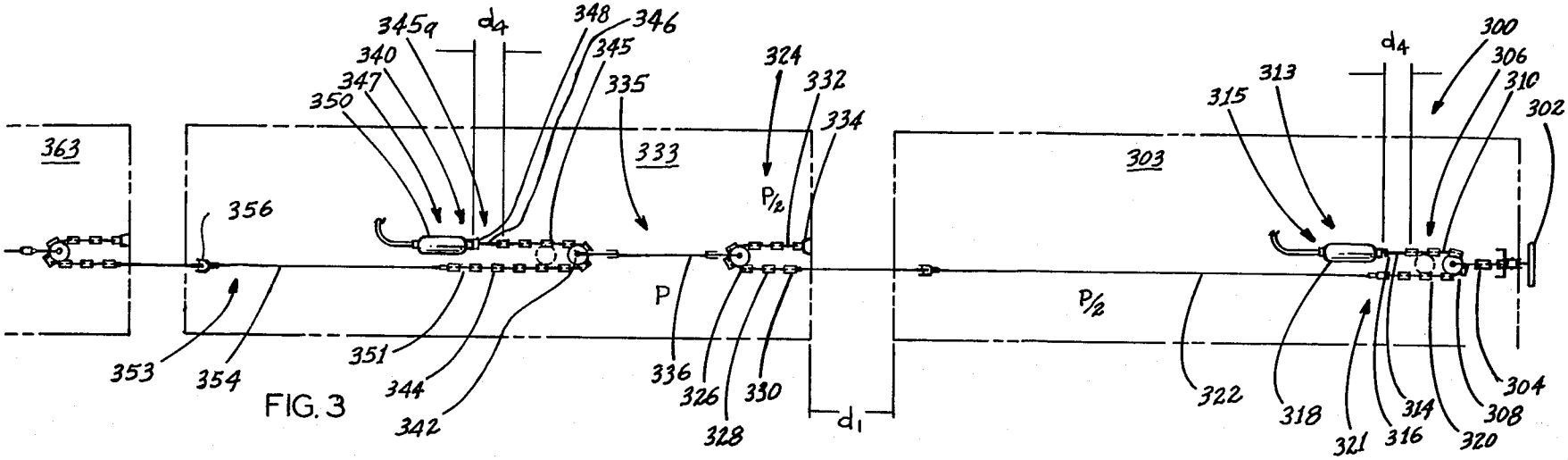

FIG. 3 is a schematic illustration of the hand brake arrangement of the present invention, also indicating the original distance D1 between adjacent rail cars and the distance D4 which is less than D3, which the push rod moves when curves are traversed according to the present invention.

Figure 2:
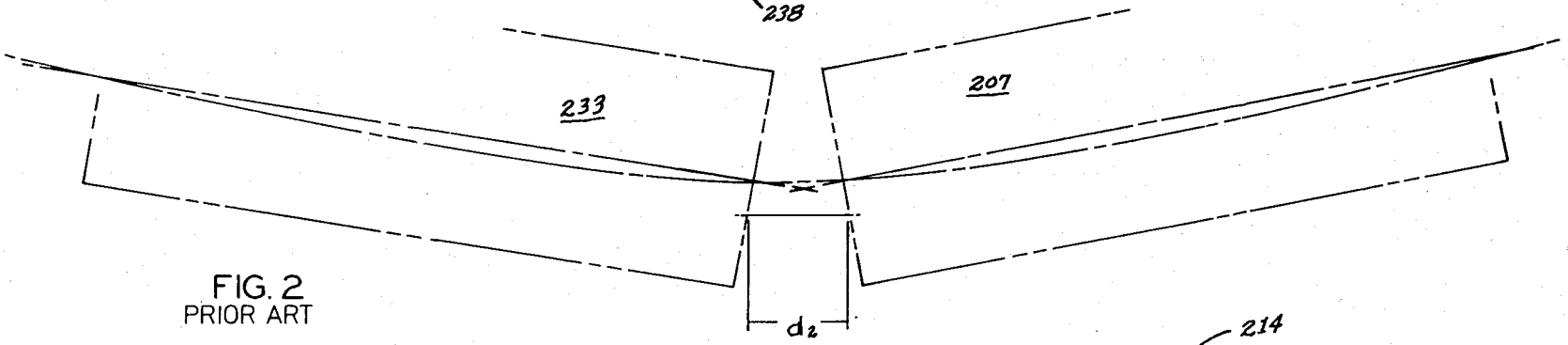
FIG. 2 PRIOR ART
FIG. 2 is a schematic illustration of the change in distance D2 between the adjacent cars as curves are traversed.
Figure 3A:
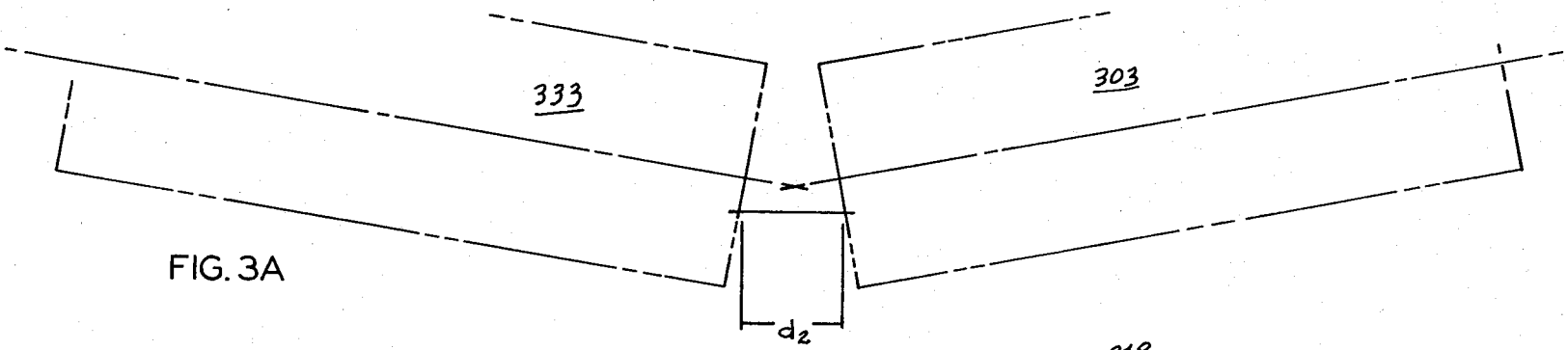

FIG. 3*a* is a schematic view similar to FIG. 2, and again illustrating the change in distance between adjacent cars D2 as curves are traversed.

Figure 3B:
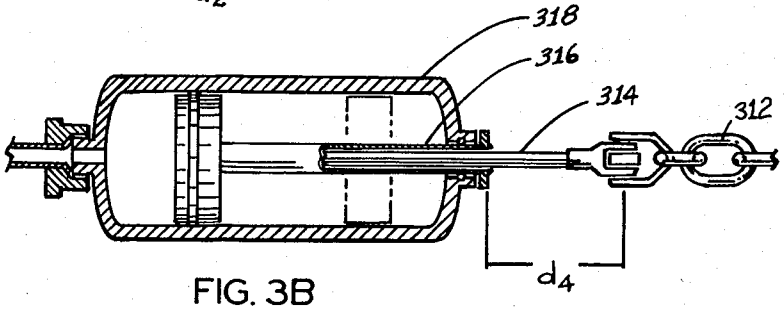

FIG. 3*b* is a vertical sectional view illustrating a brake cylinder, a brake piston, and the distance D4 which a push rod moves when curves are traversed according to the present invention.

Figure 4:
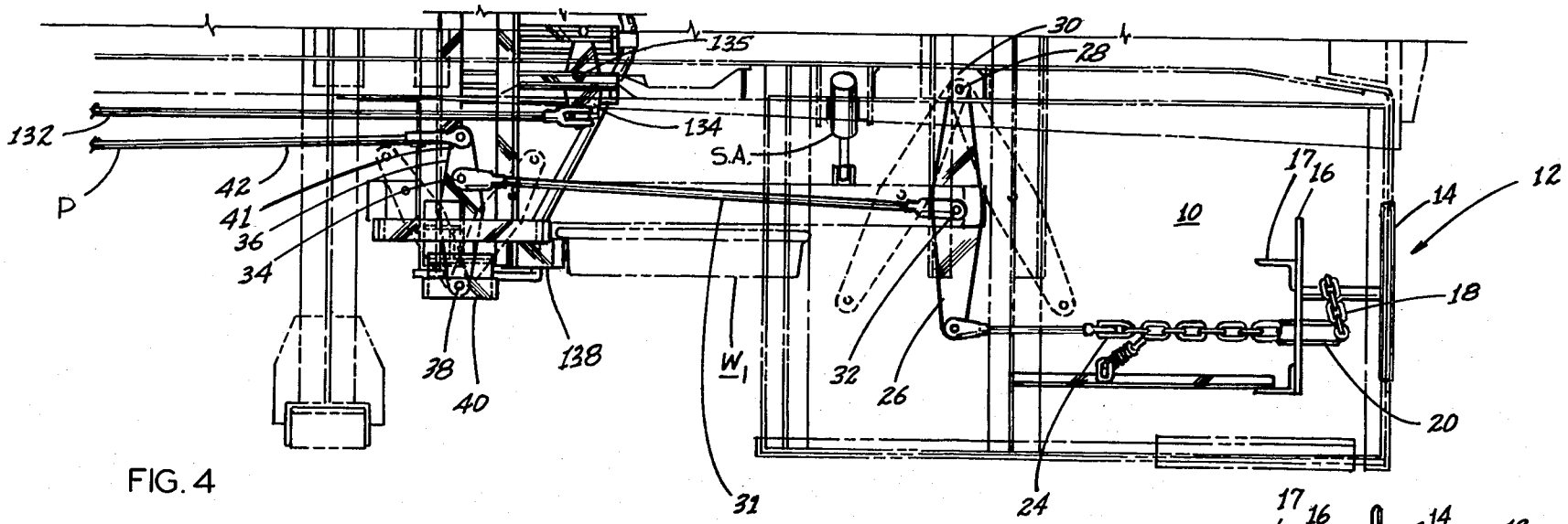

FIG. 4 is a plan view of a portion of one embodiment of the present invention.

Figure 5:
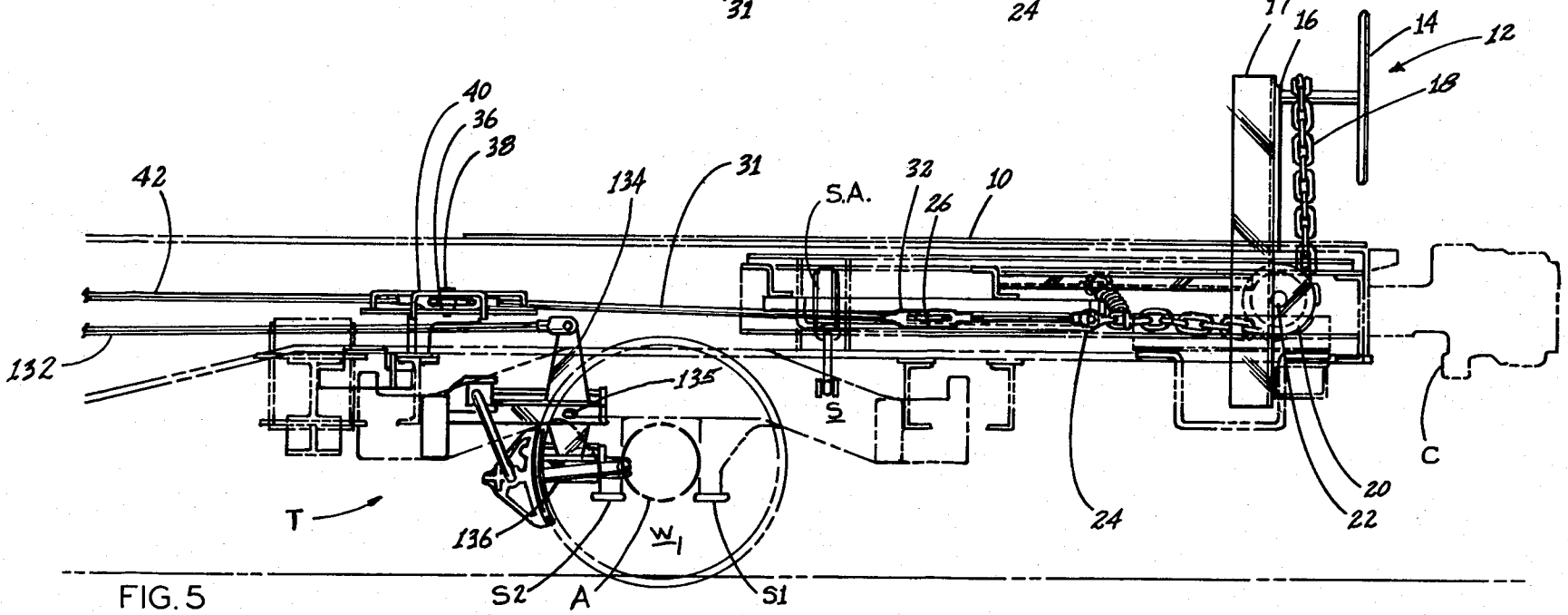

FIG. 5 is a side elevation view of FIG. 4.

Figure 4A:
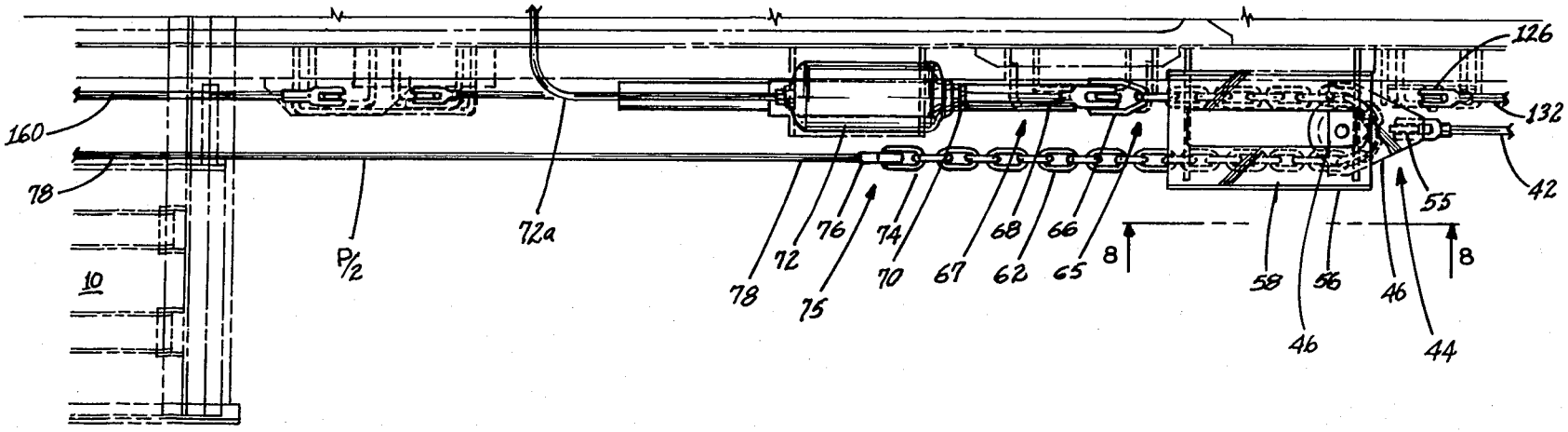

FIG. 4*a* is a plan view continuation of FIG. 4, and illustrating a force dividing means according to the present invention.

Figure 5A:
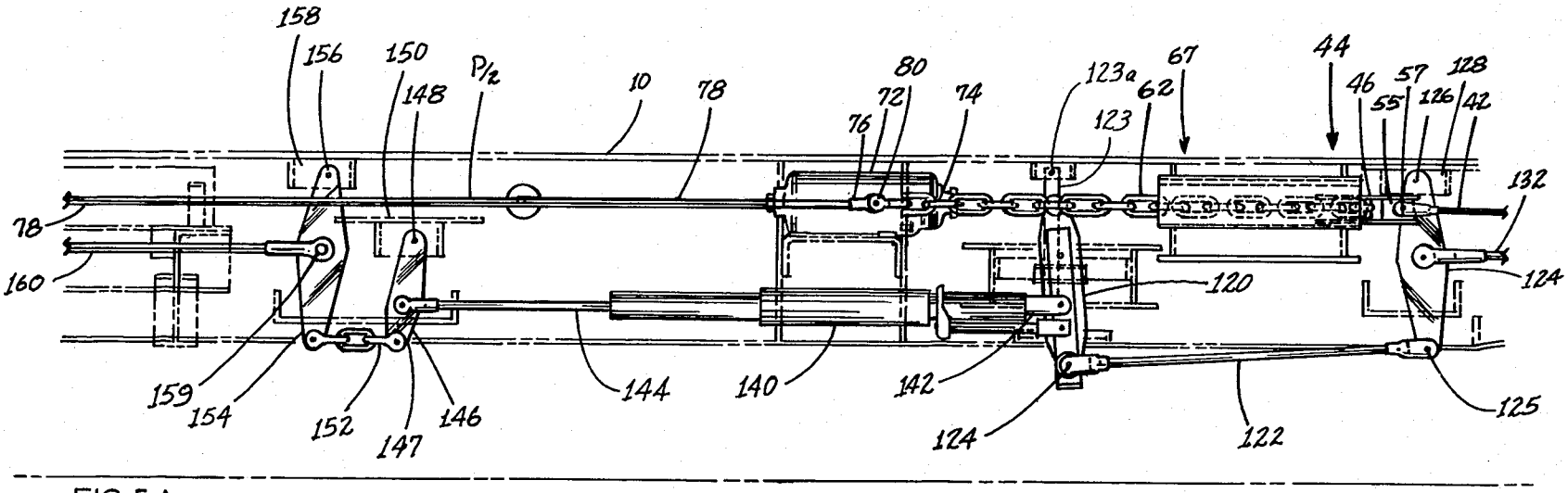

FIG. 5*a* is a side elevation continuation view of FIG. 4, and illustrating one of the floating levers of the present invention.

Figure 4B:
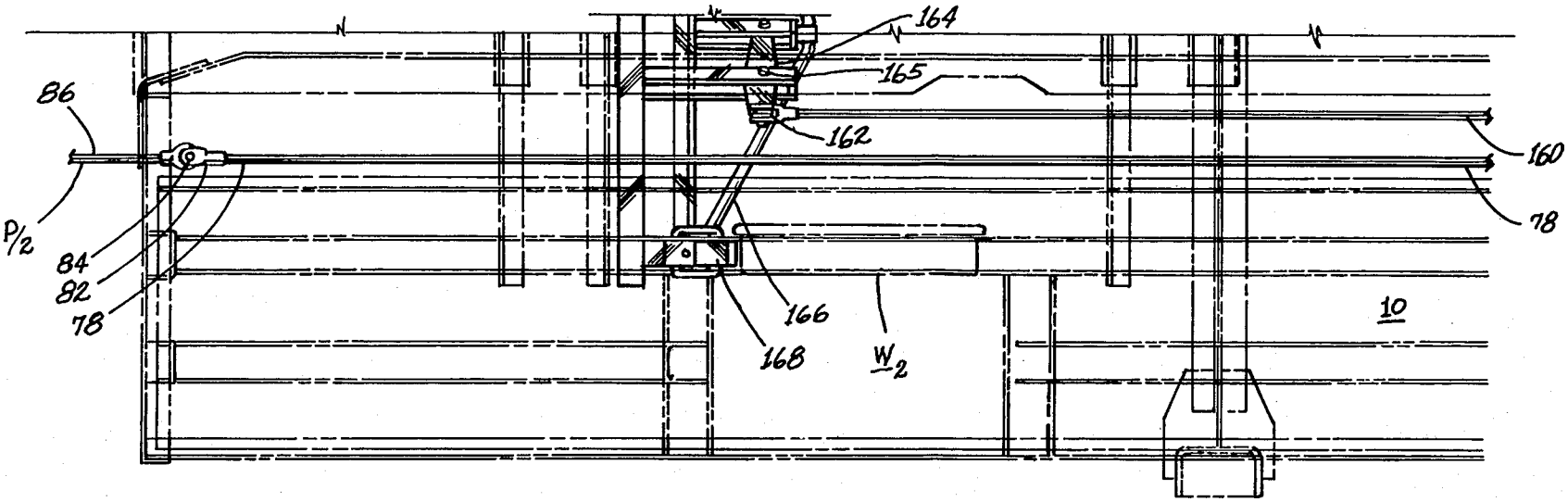

FIG. 4*b* is a plan view continuation of FIG. 4*a*.

Figure 5B:
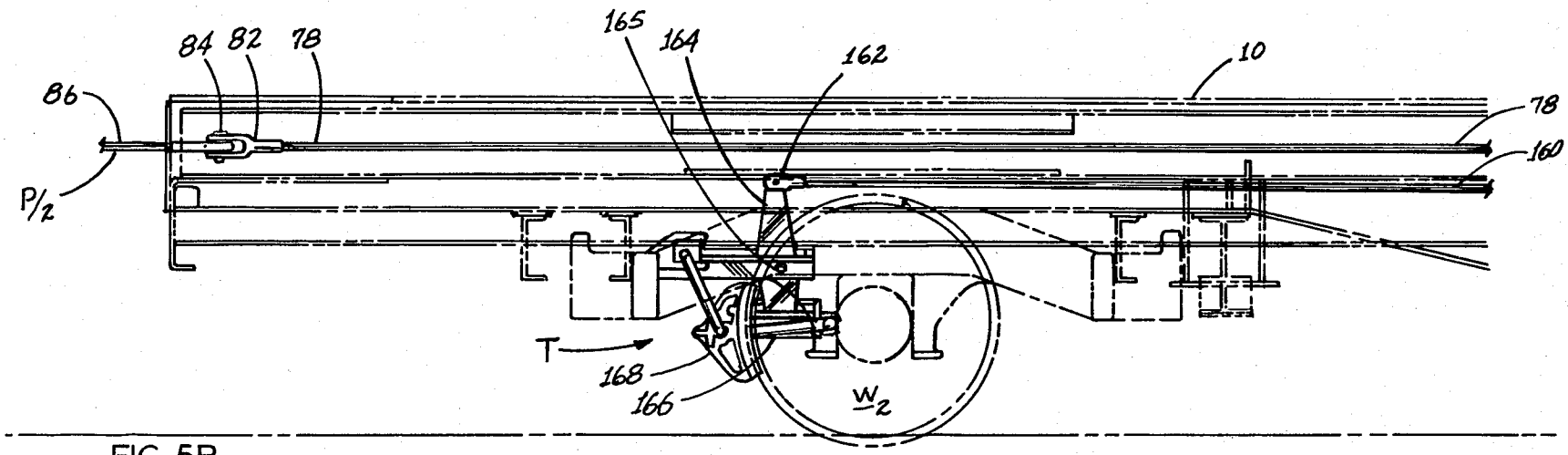

FIG. 5*b* is a side elevation continuation of FIG. 5*a*.

Figure 6:
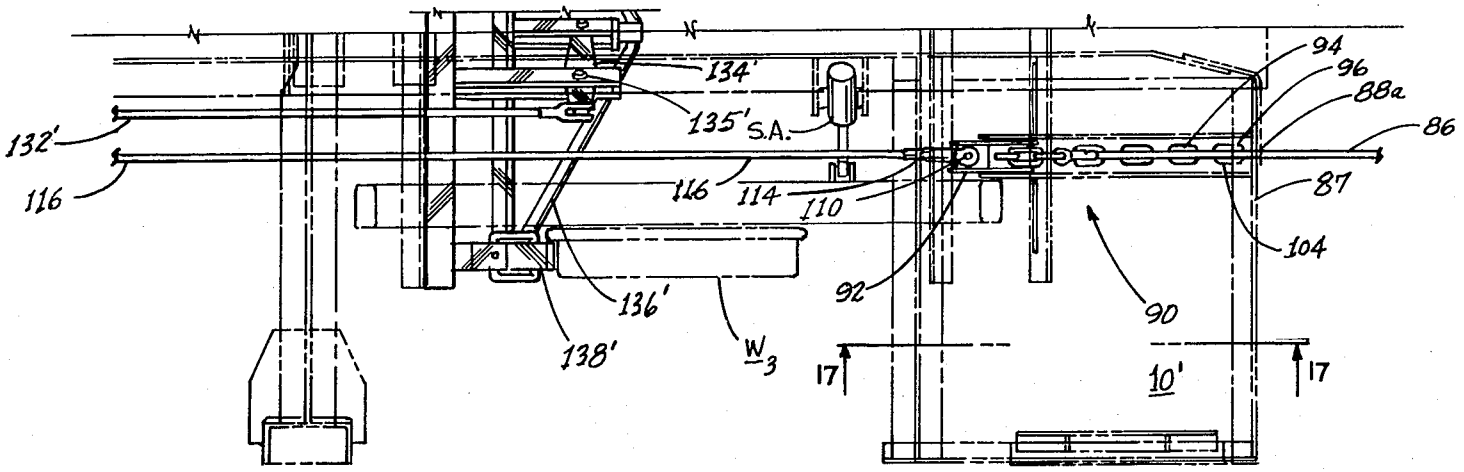

FIG. 6 is a plan view continuation of FIG. 4*b*, and illustrates the hand brake application to the next car or unit.

Figure 7:
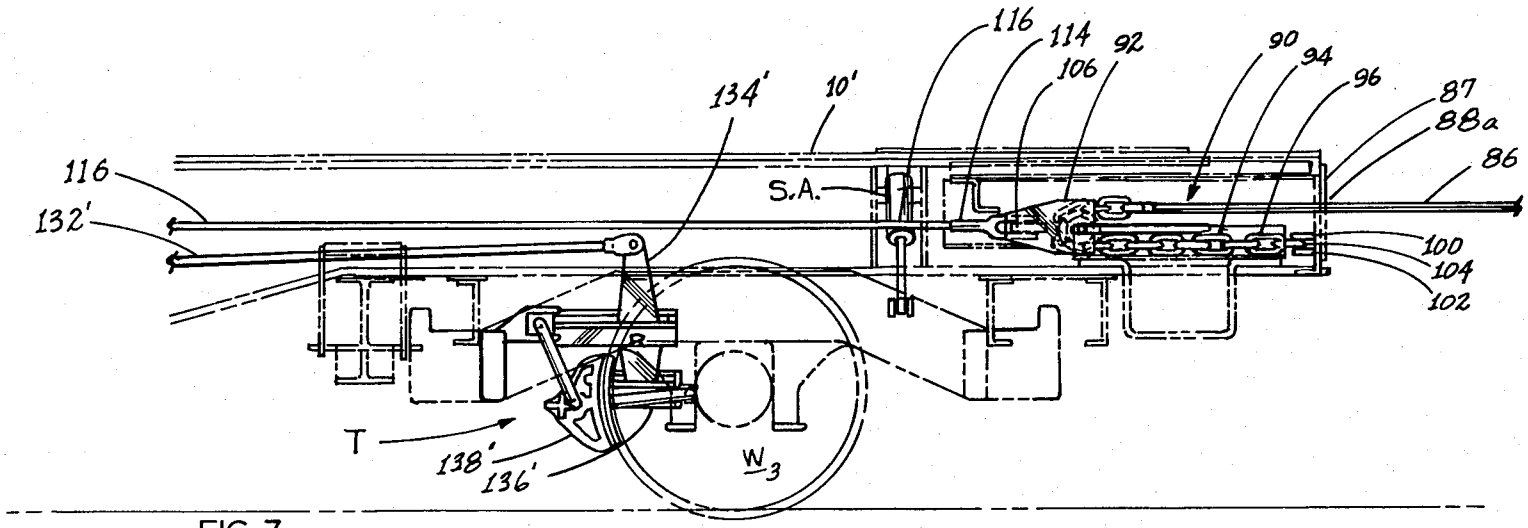

FIG. 7 is a side elevation view of FIG. 6, and illustrates a force multiplying means according to the present invention.

Figure 6A:
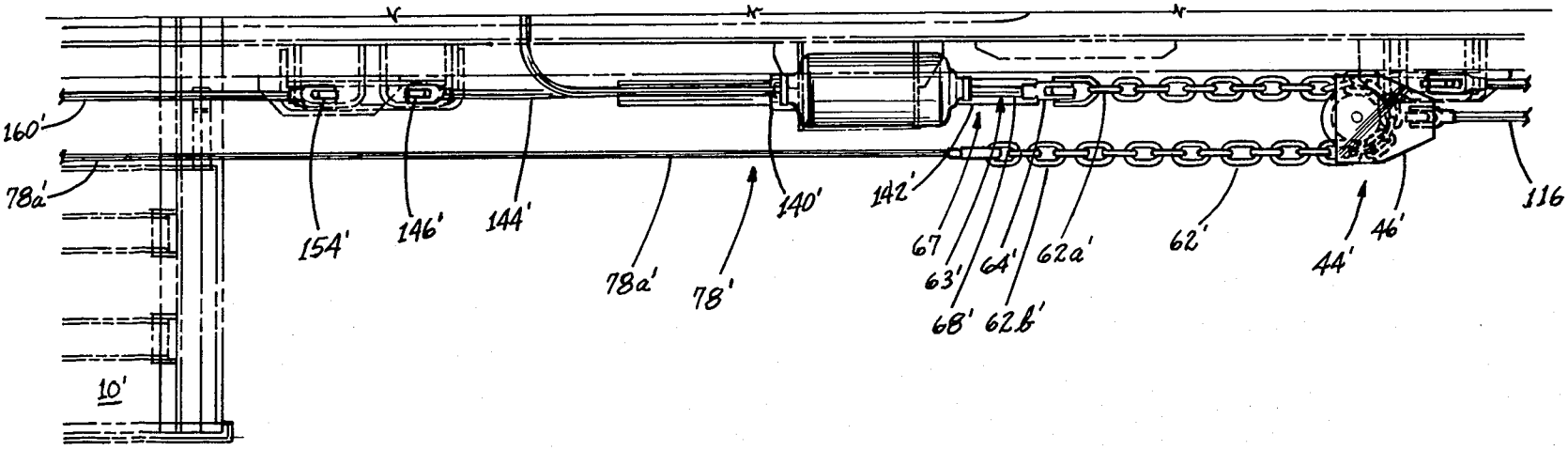

FIG. 6*a* is a plan view continuation of FIG. 6, and illustrates a force dividing means according to the present invention.

Figure 7A:
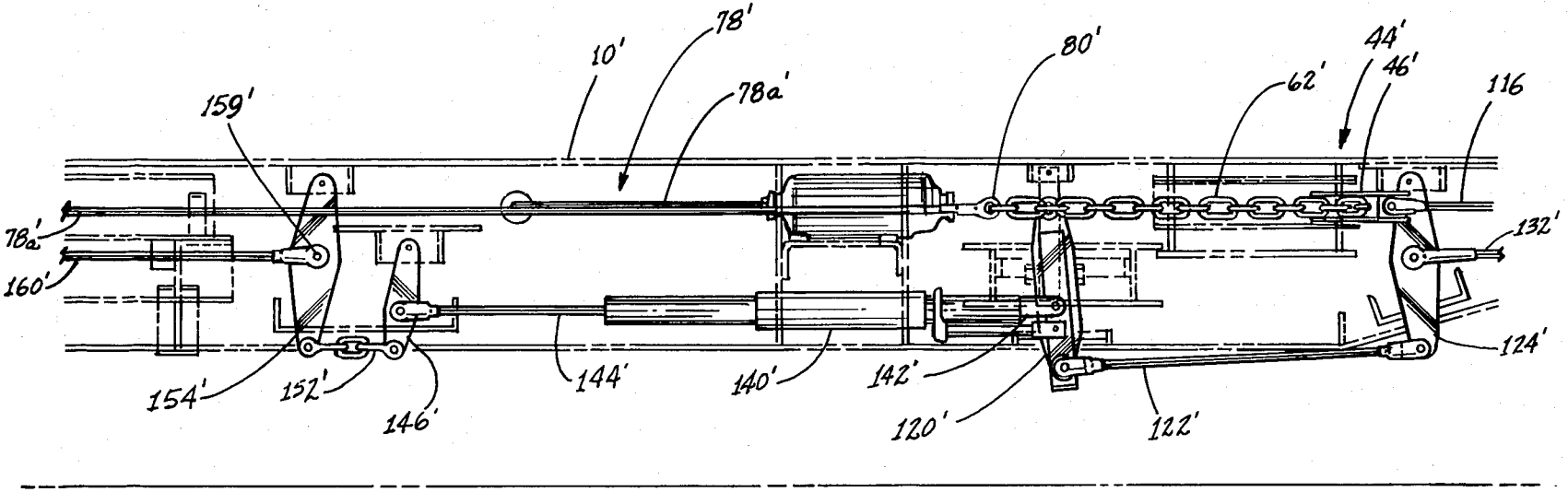

FIG. 7*a* is a side elevation view of FIG. 6*a*, and illustrates a floating lever according to the present invention.

Figure 6B:
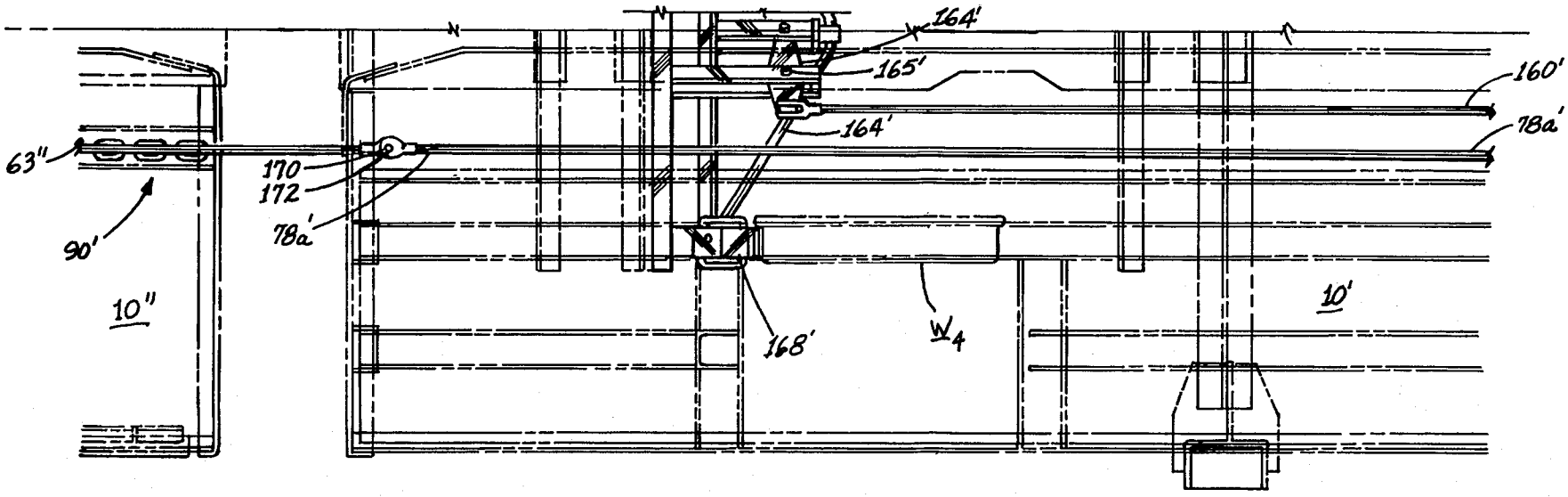

FIG. 6*b* is a plan view continuation of FIG. 6*a*, and illustrates the end of the second car and an alternative wherein the hand brake arrangement of the present invention is applied to a third car.

Figure 7B:
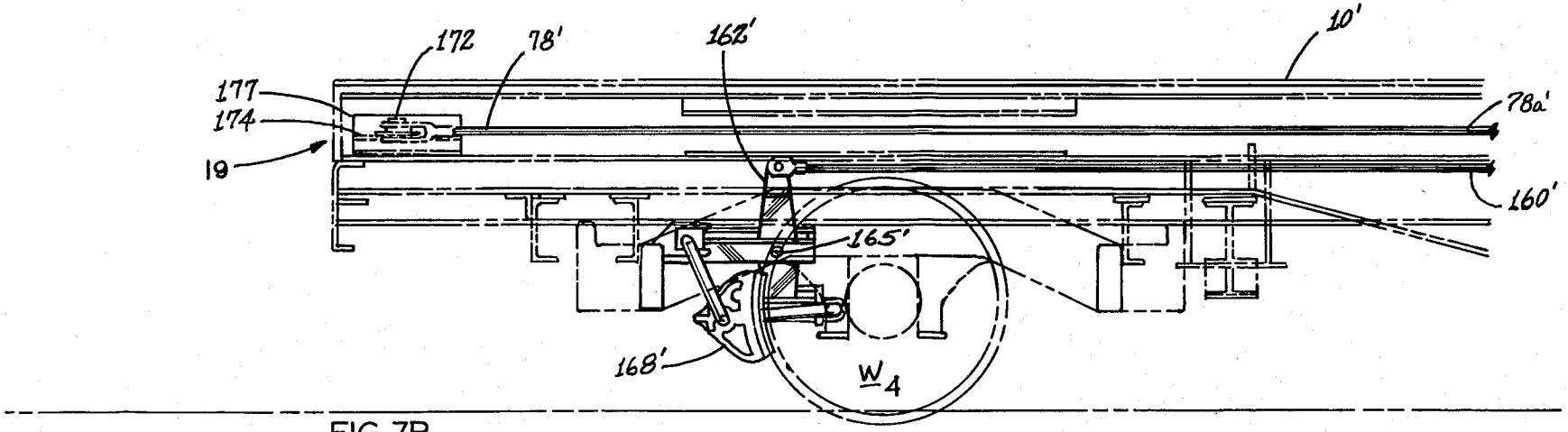

FIG. 7*b* is a side elevation view of a portion of FIG. 6*b*, and illustrating the attachment of the hand brake force to the end of the second car.

Figure 8:
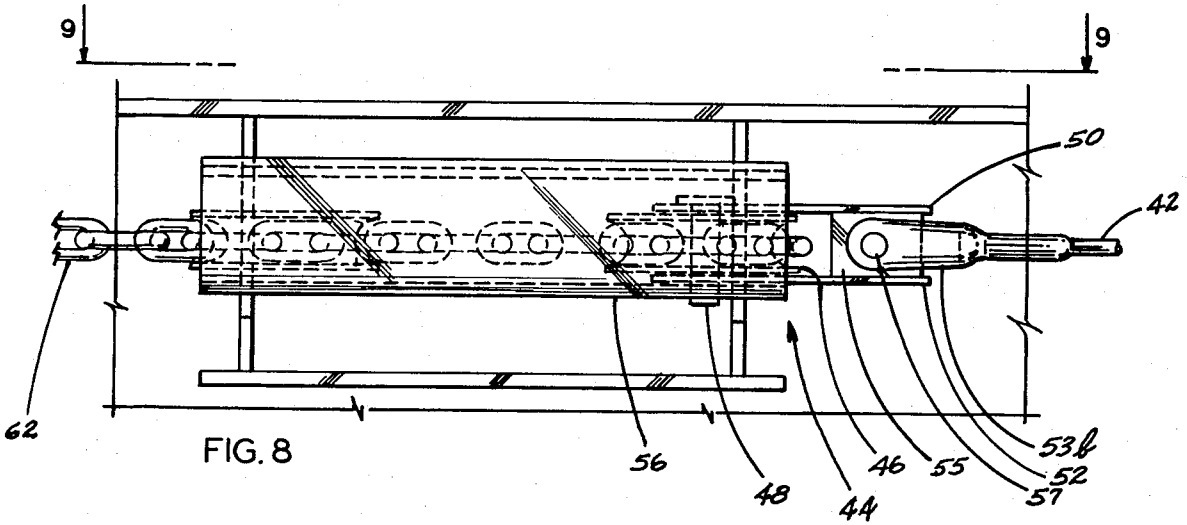

FIG. 8 is an enlarged side elevation view looking in the direction of the arrows along the line 8—8 in FIG. 4*a*.

Figure 9:
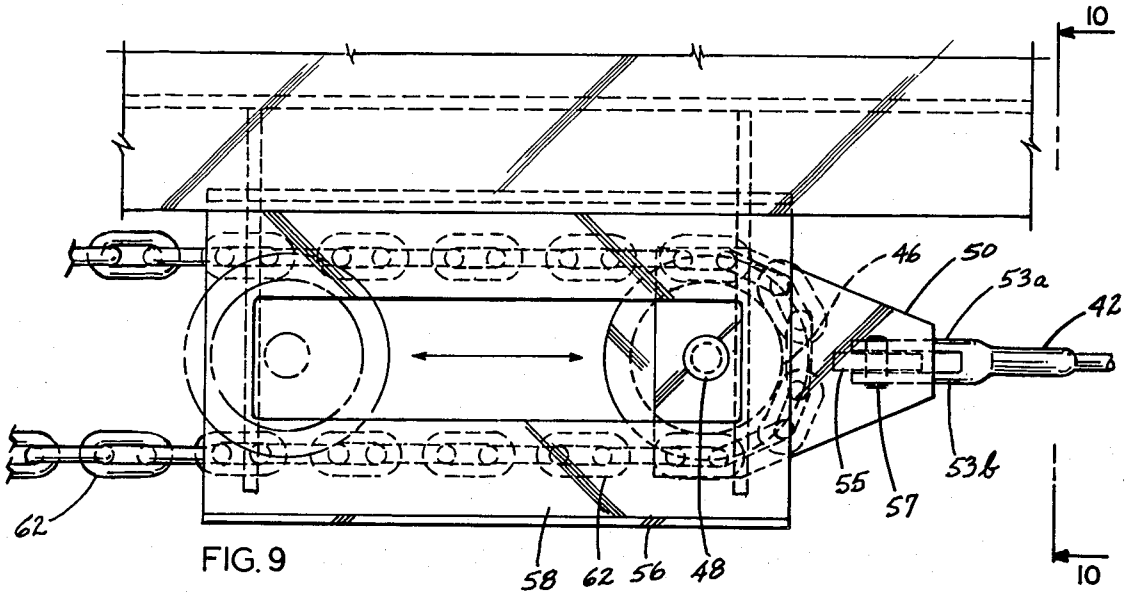

FIG. 9 is a plan view of FIG. 8, and illustrating two positions of the force dividing means of the present invention.

Figure 10:
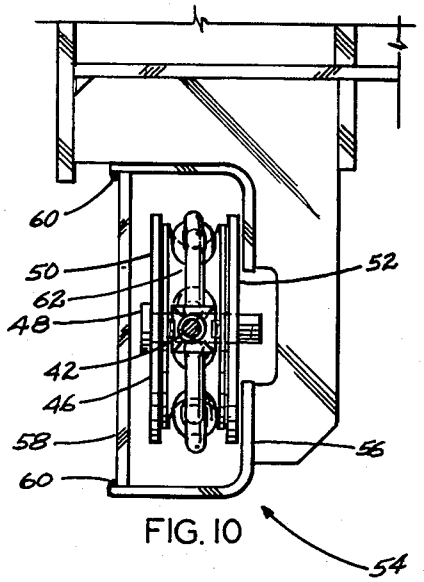

FIG. 10 is an end elevation view looking in the direction of the arrows along the line 10—10 in FIG. 9.

Figure 11:
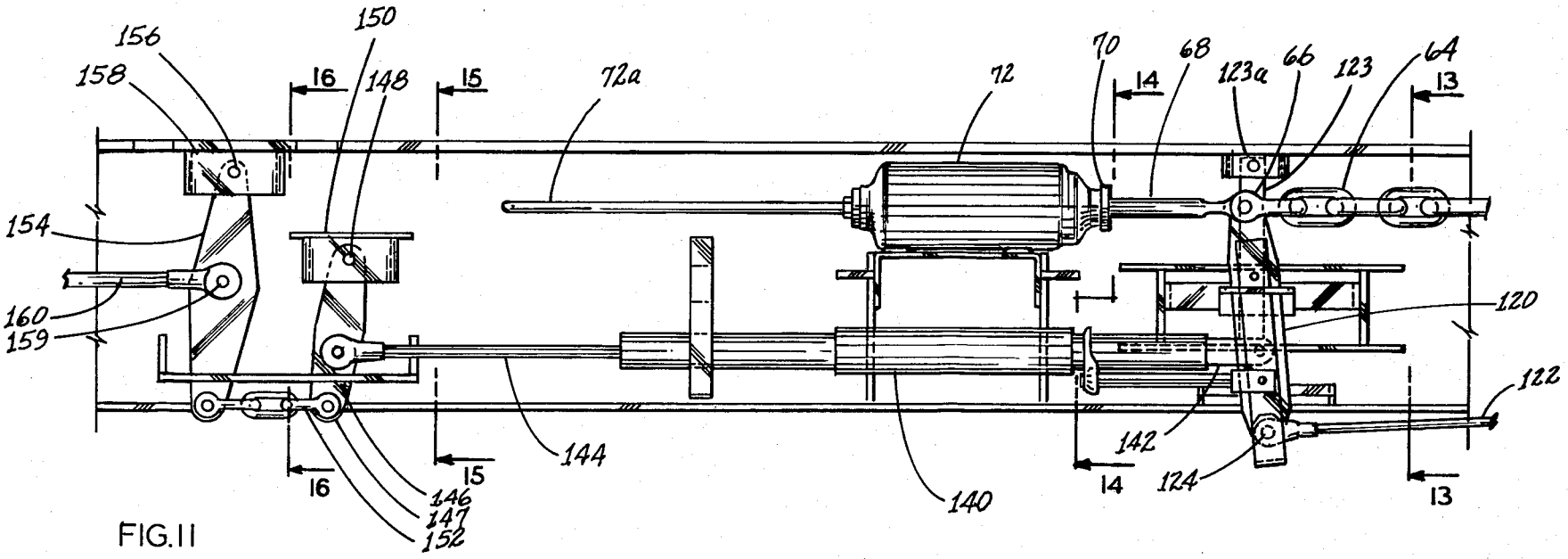

FIG. 11 is an enlarged side elevation view of a portion of FIG. 5*a*.

Figure 12:
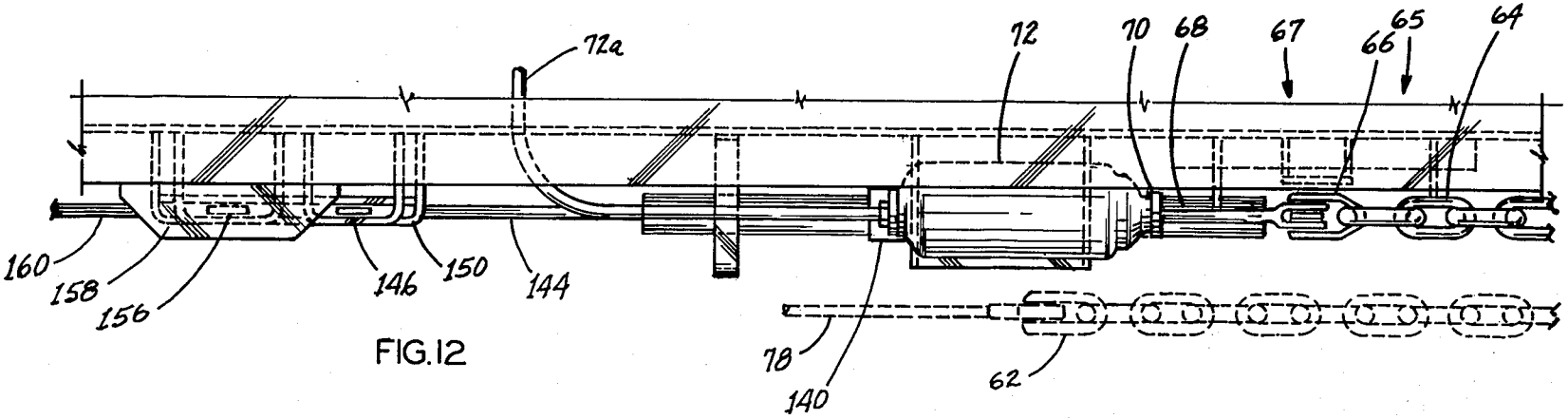

FIG. 12 is a plan view of FIG. 11.

Figure 13:
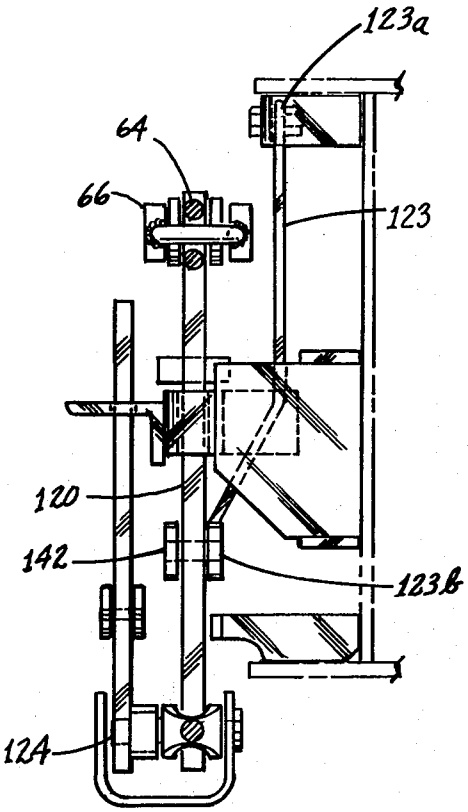

FIG. 13 is an end elevation view looking in the direction of the arrows along the line 13—13 in FIG. 11.

Figure 14:
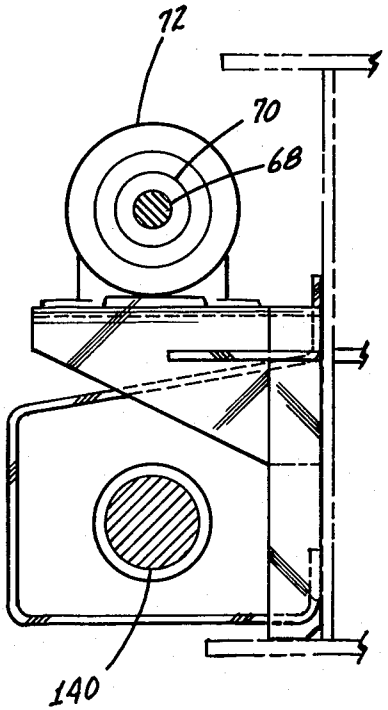

FIG. 14 is an end sectional view looking in the direction of the arrows along the line 14—14 in FIG. 11.

Figure 15:
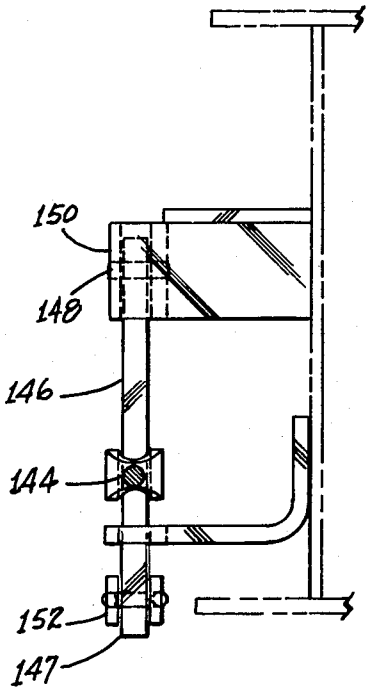

FIG. 15 is an end sectional view looking in the direction of the arrows along the line 15—15 in FIG. 11.

Figure 16:
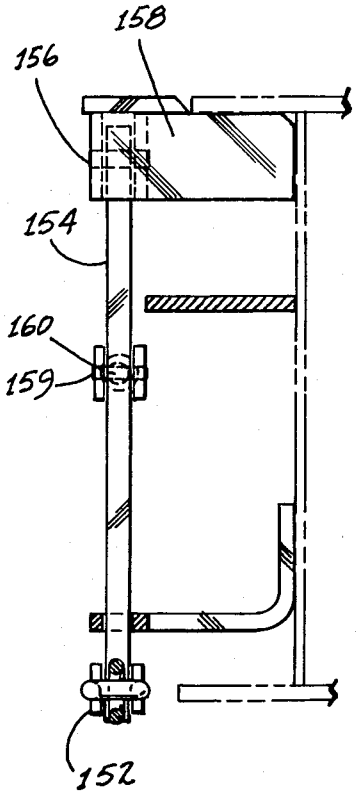

FIG. 16 is an end sectional view looking in the direction of the arrows along the line 16—16 in FIG. 11.

Figure 17:
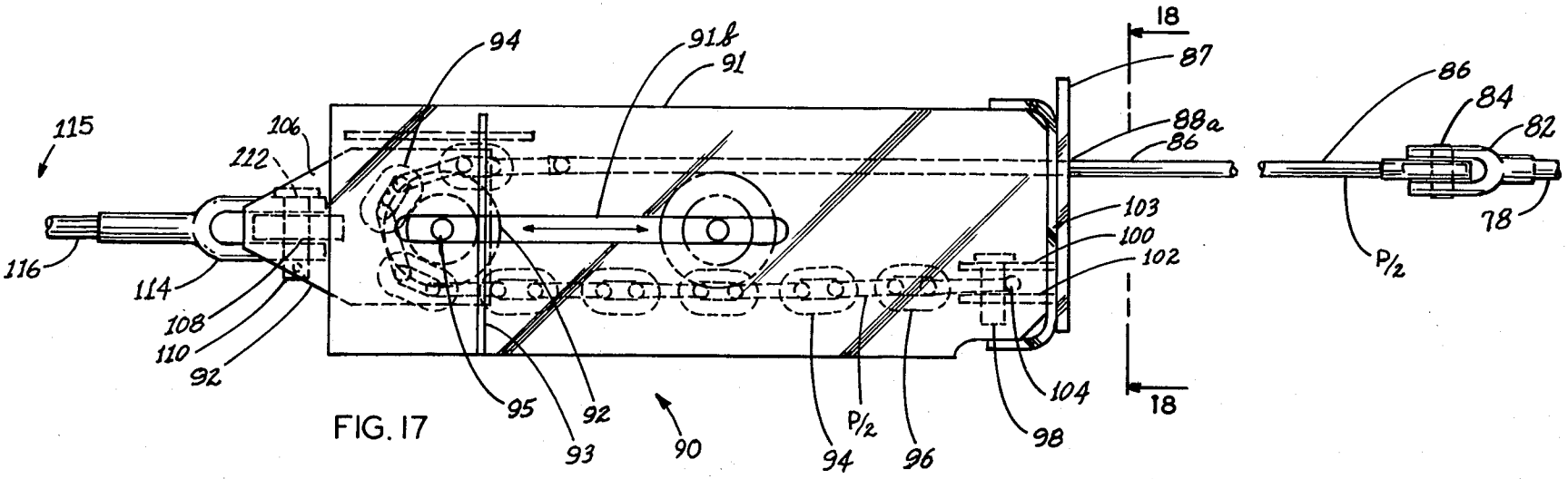

FIG. 17 is an enlarged side elevation view looking in the direction of the arrows along the line 17—17 in FIG. 6.

Figure 18:
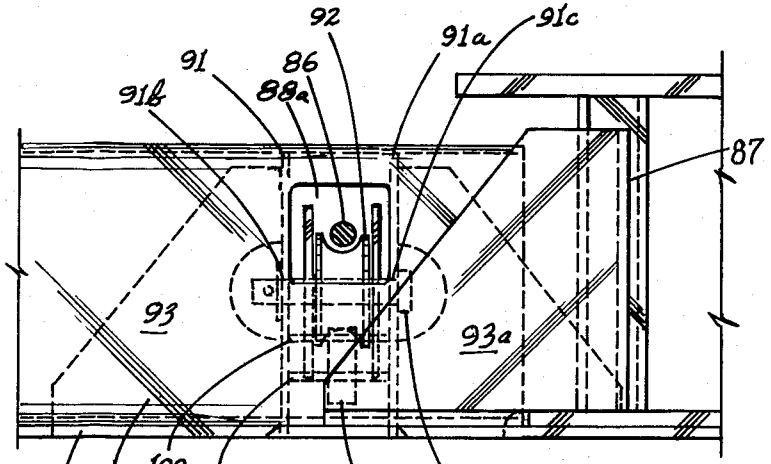

FIG. 18 is an end sectional view looking in the direction of the arrows along the line 18—18 in FIG. 17.

Figure 19:
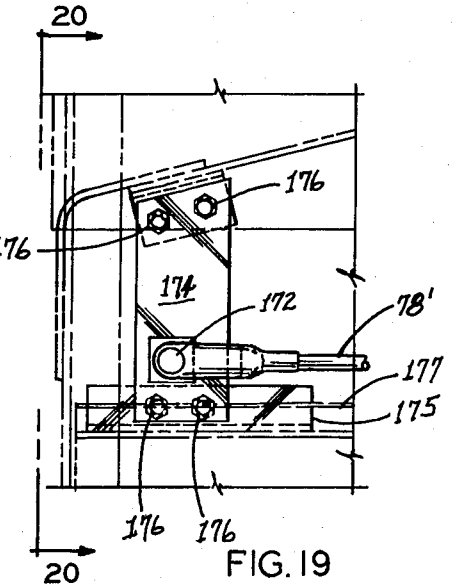

FIG. 19 is an enlarged plan view of a portion of FIG. 6*b*, and illustrating connecting the rod to the end portion of the second car.

Figure 20:
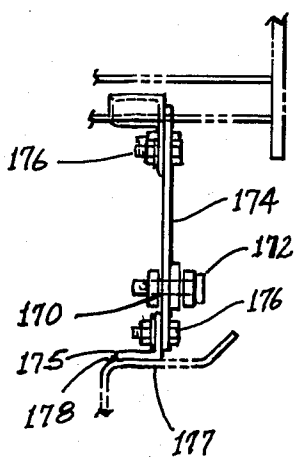

FIG. 20 is an end view looking in the direction of the arrows along the line 20—20 in FIG. 19.

BACKGROUND OF THE INVENTION

This invention relates to hand brakes for railway cars. In particular, it relates to application of hand brake force to a plurality of cars or articulated car units where the hand brake operating wheel is located on only one of a plurality of cars or units.

Railway cars are joined together by a coupler and each is supported by a pair of trucks located between each end of the car. Articulated cars are usually joined together by a draw-bar. Usually articulated units are supported on at least one end by a truck which also supports another articulated unit. However, in some cases articulated units are supported at each end by a pair of trucks.

The present invention is applicable to both railway cars and articulated units as defined above. In this application the term "cars" is inclusive of both railway cars and car units in articulated cars.

It has been proposed to divide the hand brake force applied by the operating wheel by the use of a force dividing sheave located adjacent the hand brake wheel. The sheave adjacent the hand brake wheel is connected to a push rod extending out of a hollow piston extending into the brake cylinder. Rotation of the hand brake wheel will apply the brakes if the push rod is extended a suitable designed distance such as 7". A force multiplying sheave at the end of the first unit or car is used to reestablish the original hand brake force. This force is then transferred to the next car or unit by a rod extending between the cars or units.

However, this results in substantially the original hand brake force being transferred between adjacent cars as originally applied at the hand brake wheel. When the train goes around corners the distance between adjacent cars increases or decreases depending upon the distance of curve rotation. In the situation where the distance between adjacent cars or units decreases, if the force transferred between adjacent cars is substantially the same as that originally applied by the hand brake, the movement of the cars away from each other will cause the push rods on each car unit to extend the full additional distance between adjacent cars. In many instances, this movement of the push rods will be sufficient to apply the brake shoes to the wheels and stop the train or at least cause excessive wear of the shoes and wheels. Thus this proposed construction is disadvantageous and may be inoperative in that the brake are applied in transit with sufficient force to stop the train.

In application Ser. No. 272,599 filed June 11, 1981, assigned to the same Assignee as the present application, a force dividing sheave is used to divide the applied hand brake force on a first articulated unit, and a brake rod extends from one unit to the next to apply the hand brake force to an adjacent unit.

However, this arrangement uses truck mounted brakes and the hand brake linkage is not connected to the truck mounted brake system.

SUMMARY OF THE INVENTION

In accordance with the present invention, a hand brake assembly (300) is mounted adjacent one end of a first car or articulated unit (303). A force dividing means (306) is provided on the first car, which divides the applied hand brake into a first (313) and second (321) hand brake linkages. The first hand brake linkage (313) is connected to a first air brake linkage means (315) located on the first car. Preferably a portion of the first air brake linkage means is located within an air brake cylinder (318). When the hand brake is applied, the first hand brake linkage means (313) is effective to apply the brakes on the first car or unit through the first air brake linkage (315). The second hand brake linkage (321) extends from one car or unit to a second adjacent car or unit (333). A force multiplying means (324) is provided on the second car or unit which increases the hand brake force of the second hand brake linkage to a level sufficient to apply the brakes on the second car or unit through a second air brake linkage means (340) located on the second car or unit. The force multiplying means preferably increases the hand brake force to a level substantially equal to the originally applied hand brake force. A second force dividing means (342) is optionally provided on the second car or unit between the force multiplying means (324) and the second air brake linkage means (340). The second force dividing means divides the hand brake force coming from the force multiplying means into third (346) and fourth hand brake linkages, (354). The third hand brake linkage is connected to the second air brake linkage means (340) to apply the hand brake force to the second car or unit through the second air brake linkage means. The fourth hand brake linkage (354) may extend to a third car or unit. A second force multiplying means (374) may be provided on the third car or unit which functions on the third car in the same manner as the first force multiplying means on the second car. Alternatively, the fourth hand brake linkage means may be removably connected to the second car or unit (356).

Lever means (26,36) are provided to adjust the applied hand brake force to suitable brake application levels, and which lever means avoid interference with structure on the cars or units.

DETAILED BACKGROUND DESCRIPTION

In FIG. 1, a hand brake system 200 is illustrated including a hand brake wheel 202 connected by a chain 203 to a force dividing means 204, such as a sheave 206 around which is wound a chain 208. One end of the chain 208 is connected to a push rod 210 located within a piston 212 located within a brake cylinder 214. The other end 209 of the chain 208 is connected to a rod 216. Rod 216 is connected to a force multiplying means 220 located on the same car or unit 207 as the wheel 202 and the force dividing means 204. Force multiplying means 220 includes a sheave 222 about which is wound a chain 224. One end of the chain 224 is connected to the rod 216. The other end 229 of the chain 224 is connected to the car body at 230. While the force dividing means 204 divides the applied hand brake force in half, the force multiplying means 220 reestablishes substantially the same applied brake force as applied to wheel 202. Therefore, a rod 232 connected to sheave 222 and extending to an adjacent 233 unit has substantially the same applied hand brake force as applied by the wheel 202.

A second force dividing means 234 is provided on the second car including a sheave 236. A chain 238 is wound about the sheave. A first end 240 of the chain is connected to a push rod 242 located within a piston 244 which in turn is located within a brake cylinder 246. The other end 247 of the chain 238 is connected to a rod 250 which is connected to a chain 252 located on a force multiplying means 254. One end 255 of the chain 252 is connected to the rod 250. The other end 258 is connected to the car body at 260.

The difficulty with this arrangement is illustrated in FIG. 2. When the units 207 and 233 go around curves, the original distance between the units $d_1$, for example 22" as illustrated in FIG. 1, will increase significantly on one side of the cars or units $d_2$, for example, to as much as 29" as illustrated in FIG. 2. In this event, the amount of displacement of the push rods 210 and 242, $d_3$, on the respective units 207 and 233 is the full 7" of added displacement. This displacement of 7" is sufficient to apply the brakes in many circumstances. More severe corners would result in even greater displacement and certain application of the hand brake force. This would result in either the train stopping and/or severe wear of the brake shoes and wheel application of the brakes.

GENERAL DESCRIPTION OF THE INVENTION

In accordance with the present invention, in its broadest aspects, a hand brake arrangement 300 (FIG. 3) is provided including a hand brake wheel 302 mounted upon a car or articulated unit 303. A chain 304 connected to the wheel 302 is connected to a force dividing means indicated at 306. In one embodiment this force dividing means 306 may comprise a sheave 308 about which is mounted a chain 310. The chain includes a first end 312 which is connected to a first hand brake linkage 313 including a push rod 314 which is connected to an air brake linkage means 315 located within a piston 315 in a brake cylinder 318. The opposite end 320 of the chain 310 is connected to a second hand brake linkage means 321 including a rod 322 which extends the full length of the unit 303, and extends to an adjacent unit 333. On the second unit 333, a force multiplying means 324 is provided. This force multiplying means includes a sheave 326 about which is mounted a chain 328 having a first end 330 connected to a rod 322. The chain 328 includes a second end 332 which is connected to the car body at 334.

Because of the force dividing means 306, the hand brake force in the rod 322 is P/2. This same force P/2 is also present in the chain 328 which is connected to the car body at 334. In order to react these two forces of P/2, a force of P is located in a third hand brake linkage means 335 including a rod 336 connected to the force multiplying means 324. The rod 336 is connected to a force dividing means 340 which may comprise a sheave 342 about which is mounted a chain 344. One end 345 of the chain 344 is connected to a fourth hand brake linkage means 345*a* including a push rod 346 located within second air brake linkage means 347 including a piston 348 located within a brake cylinder 350. The other end 351 of the chain 344 is connected to a fifth hand brake linkage means 353 including a rod 354 which either extends to another unit 363 to apply the brakes to this unit or may be connected at its end 356 with a suitable removable connection.

On the straight track units 303 and 333 are located a given distance apart $d_1$, for example, a distance of 22 feet between adjacent units. However, in transit when the units 303 and 333 negotiate curves the distance between units $d_2$ increases as illustrated regarding units 207 and 233 in FIG. 2 and FIG. 3A.

Since the applied brake force in rod 322 is P/2, the amount of displacement of the respective push rods 314 and 346, $d_4$, is one-half that illustrated in FIG. 2 or only about 3½". This is not a sufficient displacement to apply the hand brake force when curves are negotiated. Even if the displacement were slightly in excess of 22 feet, the hand brake force would not be applied. It therefore is seen that the present invention provides a much improved and clearly operative hand brake arrangement over that proposed in FIG. 2.

DETAILED DESCRIPTION OF PREFERRED EMBODIMENTS

The hand brake arrangement of the present invention 12 (FIGS. 4 and 5) is mounted upon a railway intermodal TOFC car 10. The railway TOFC car 10 is supported by a pair of single axle trucks "T" having respective wheels "W". The car 10 is connected to an adjacent car (not shown) by means of a conventional coupler "C". However, cars of four or six units are connected to adjacent units by means of draw bars (not shown). A single axle suspension system includes a longitudinally extending side frame "S" having depending portions S1 and S2 which receive a transverse axle "A".

The hand brake arrangement 12 includes a hand brake wheel 14 rotatably mounted on a vertically extending hand brake plate 16 supported by angles 17 in a conventional manner. The hand brake wheel 14 is in engagement with a chain 18 which extends around a pulley 20 rotatably mounted by means of a suitable pin 22 mounted on the car 10. The chain 18 is connected at its inner end 24 to a horizontally extending hand brake lever 26, which is pivotally mounted at 28 by means of suitable brackets 30. A mechanical advantage is gained and the applied hand brake force is increased from 6,800 pounds to 13,600 pounds. A released position is shown in the leftmost view, a two unit applied position in the center view, and an optional three unit applied view in the right hand view. A brake rod 31 is connected to the midportion 32 of the lever 26. Brake rod 31, at its inner end 34 is connected to another horizontally extending brake lever 36 pivotally mounted at 38 upon the car 10 by means of suitable support brackets 40. Location of brake rod 30 in this position avoids interference with the wheel (W1) and the truck shock absorber "SA". Again the released position for the lever 34 is shown at the left, the two car applied position is shown in the right hand partial view.

At the distal end 41 of horizontal lever 36, another brake rod 42 is connected. However, it will be noted that while the rod 31 is connected to the lever 26 generally at the midpoint of the lever, the rod 31 is connected to lever 36 at a distance closer to the distal end 41 than to the pivot end 38 in ratio of approximately 5 to 13. Thus while the location of lever 26 results in an increase in the applied brake force of 6,800 to 13,600 pounds, the location of the lever 36 and its connection point 34 results in a decrease in the brake force of 13/18 of 13,600 pounds to approximately 9,820 pounds.

Rod 42 (FIG. 4A) is connected to a first hand brake force dividing means indicated generally at 44. Force dividing means 44 preferably comprises a sheave 46. Rod 42 is bifurcated and includes end pieces 53*a*, 53*b* (FIGS. 8,9 & 10). A plate 55 extends between the end pieces 53*a* and 53*b* and is welded to cover plate 50 and 52. A fastener 57 extends horizontally through all three members. Sheave 46 is rotatably mounted by means of a vertically extending pin 48 and upper and lower cover plates 50 and 52 (FIG. 8). The assembly of sheave 46, pin 48 and plates 50 and 52 is vertically movable within a closure indicated generally at 54, comprising a channel 56 and a closure plate 58 welded to the channel at 60 (FIG. 10).

A chain 62 extends about the sheave 46. One end 64 of the chain is connected to a first hand brake linkage means 65 including a clevis 66 (FIG. 12). The clevis 66 is connected to a first air brake linkage means 67 including a brake cylinder push rod 68 (FIG. 2). Push rod 68 is located within a hollow brake rod piston 70 which in turn is located within a brake cylinder 72 (FIG. 4*a*) including an air admitting conduit 72*a* in a conventional manner. When push rod 68 is pulled by clevis 66 the hand brake force is applied to the wheels W1 through the air brake system in a manner to be described hereafter.

As shown in FIGS. 4A and 5A, the other end 74 of the chain is connected to a second hand brake linkage means 75 including a clevis 76 which in turn is connected to a brake rod 78 by means of a pin 80. The result of the application of the sheave 46 is to divide the brake force from rod 42 in half with approximately half being applied to the first hand brake linkage means 65 and half applied to the second hand brake linkage means 75 including brake rod 78. The released position is indicated in the far left relative to rod 78, and the applied position to the right thereof in FIGS. 8 and 9.

The rod 78 then extends down the remaining length of the unit and is provided with a bifuracted end 82 (FIGS. 4B and 4B). A vertically extending pin 84 connects, a rod 86 which extends to an adjacent car unit indicated at 10' (FIG. 6). Thus the force passing through rod 86 to a joint unit is P/2 or about 4,900 pounds.

In the adjacent car unit 10' the rod 86 passes through an opening 88*a* above the end sill 87 and is connected to a force multiplying means 90 including a sheave 92 and a chain 94. The opposite end 96 of the chain 94 is connected to the car body as shown in FIG. 17 by means of a vertically extending pin 98, extending through a pair of plates 100 and 102 and a horizontally extending chain link 104. Plates 100 and 102 are welded to a bracket 103 welded to end sile 87. Laterally spaced plates 91 and 91*a* (FIG. 18) supported by gussets 93 and 93*a* (FIG. 18) define a channel through which the sheave is longitudinally movable. A pin 95 (FIG. 18) extends between slots 91*b* and 91*c* in plates 91 and 91*a* to provide movement of the sheave. The force in rod 86 is P/2. The force in chain 96 is also P/2. The force in 95 to react these forces is thus substantially P, the originally applied hand brake force.

The sheave 92 includes a vertical plate 106 having an opening 108 which receives a horizontally extending bar 110. A pin 112 extends between a bifurcated end 114 of a rod 116 and through bar 110 to connect the sheave to a third hand brake linkage means 115 including a rod 116. The rod 116 is connected to another force dividing means 44' constructed in the same manner as force dividing 44, and including a sheave 46' and a chain 62'. One end 62a' of chain 62' is connected to a fourth hand brake linkage means 63' including a clevis 64'. Clevis 64' is connected to a second air brake linkage means 67' including a brake push rod 68'. The other end 62b' of the chain 62' is connected to a fifth hand brake linkage means 78' including a rod 78a' by a pin 80', all of which is constructed in the same manner as described hereinabove in connection with FIGS. 4A and 5A.

It will be apparent that the brake force dividing means 44 divides the force applied by the hand brake wheel 14 into two substantially equal components. One component functions to apply the brakes to the wheels W1 through the action of the first hand brake linkage means 65 including a first air brake linkage means 67 including the brake push rod 68 and the rod 132. The other component applied to the second hand brake linkage means 75 including rod 78 through the opposite end 74 of the chain 62 extends the remaining length of the car unit. The force carried is P/2 because of the force dividing means 44. Rod 78 is connected to force multiplying means 90 on unit 10'. This force multiplying means 90 by virtue of the sheave 92 increases the brake force up to substantially the original multiplying level. Third hand brake linkage means 116 connects to another force dividing means 44' to apply the brakes to the second car unit 10' through a fourth hand brake linkage means 63' connected to a second air brake linkage means 67'. A fifth hand brake linkage means 78' includes another rod 78a' which may be used to apply the brakes to a third car unit 10''.

For a dual car unit, the rod 78 is integrally connected to the car 10' as indicated in the far left portion of FIG. 19. The rod 78' includes an opening 170 which receives a fastening bolt 172 extending through the plate 174. Plate 174 is held in place with fasteners 176 located at opposite ends thereof. The angle 175 is connected to the car structure 177 at 178 by means of welding.

However, for a three car unit, it would be a simple matter to disconnect rod 78' from the connecting plate 174 (FIG. 7B) and instead connect it to another force multiplying 90' constructed in the same manner as force multiplying means 90' to restore substantially the original brake force applied by the hand wheel 14 and apply the brakes on the third air brake through a third air brake linkage means 63' (FIG. 6A). It is thus seen that with the hand brake arrangement of the present invention, the hand brake can be applied to two or three car units from a wheel located on one end unit.

Application of the hand brake force through the air brake system will now be described. In FIG. 4A, push rod 68 is connected to a vertically extending floating cylinder lever 120. One end of rod 120 is connected to a longitudinally extending lever 122 at 124.

The midportion of floating lever 120 is connected to a slack adjuster 140. Slack adjuster includes a projecting portion 142 and which serves as a fulcrum for lever 120, after the portion 142 has been extended a desired amount when push rod 68 is extended.

Rod 122 is connected to a first vertically extending brake lever 124 pivotally mounted at 126 by means of bracket support structure 128. The distal end 125 of lever 124 is connected to rod 122. At its midpoint, lever 124 is connected to another brake rod 132 which is connected to a vertically extending brake beam lever 134. Brake beam lever 134 is pivoted at 135 and is connected to a brake beam 136 extending transversely of the car and includes brake shoes 138 to apply in engaged position a braking force to wheels W1.

Slack adjuster 140 includes an extension 144 which is connected to a second vertically extending lever 146. Lever 146 is pivoted at 148 by means of supportive bracket structure 150. Lever 146 at its distal end 147 is connected to a short brake rod 152. Brake rod 152 is connected to a third vertically extending brake lever 154 pivotally mounted at 156 my means of appropriate support bracket structure 158. Levers 146 and 154 adjust the brake force as follows. Vertically extending lever 154 is connected at its midpoint 159 to another longitudinally extending brake rod 160 which at its distal end 162 is connected to a brake beam lever 164. Lever 164 is provided with a fulcrum 165 and in turn is connected to a transversely extending brake beam 166 having brake shoes 168 which apply the brakes to wheels W2.

In a similar manner, a vertically extending floating lever 120' located on the second car unit 10' is connected to a longitudinally extending rod 122' which is connected to a first vertically extending brake lever 124'. Lever 124' is connected to a longitudinally extending rod 132' which is connected to a brake beam lever at 134'. Brake beam lever 134' thus applies the brake force to a brake beam 136' which applies the brakes to wheels W3 in the same manner as brake beam 136, through fulcrum 135'.

Likewise, the midportion of floating lever 120' is connected to a slack adjuster fan 142' of a slack adjuster 140'. Slack adjuster 140' includes an extension 144' which is connected to a third lever 146'. Lever 146' is connected to lever 154' by means of short brake rod 152'. Levers 146' and 154' adjust the applied brake force. Lever 154' is connected at its midpoint 159' to a longitudinally extending lever 160' which is connected to a brake beam lever 162'. Brake beam lever 162' is fulcrumed at 165' and is connected to brake beam 164'. Brake beam 164' is connected to brake shoes 168' which apply the brakes to wheels W4 in the conventional manner.

Floating lever 120 is supported by support link 123 pivotally mounted to support bracket structure at 123a. The link 123 engages the floating lever and supports the same at 123b.

Concerning the operating of floating levers 120 and 120', when wheel 14 is rotated to apply hand brakes, the cylinder lever 120 operates precisely as if an air brake application had been made. As tension in the rods 122 and the slack adjuster 140 increase, link 123 no longer supports the weight or the slack adjuster 140 because the system is in equilibrium. Positions and ratios are so balanced that the push rod 68 centers in the hollow rod without link 123. Link 123 is necessary to the operation of the system only at release. As tension in the rod 122 and slack adjuster 140 decreases (by release of the brake) vertical up load components on the cylinder lever 122 decrease. Link 123 pivots to a vertical position and assumes the load of the cylinder lever 122 and slack adjuster 140. The pivot point 123b of link 123 is so located that as the brake rigging relaxes (i.e. as brake forces are released) the slack adjuster weight is supported and the lever 120 further rotates allowing the push rod 68 to return back into the hollow rod 70.

What is claimed is:

1. A hand brake assembly for use with separate railway cars or articulated car units comprising:

a wheel assembly mounted adjacent one end of a first car; means connecting said wheel assembly to a first force dividing means located on the first car which divides the applied hand brake force into first and second hand brake linkages; each having a reduced hand brake force; said first hand brake linkage connected to a first air brake linkage means located on the first car; whereby when the hand brake is applied, said first hand brake linkage is effective to apply the brakes on the first car or unit through said first air brake linkage; said second hand brake linkage extending from one car to a second adjacent car; means connecting said second hand brake linkage to a force multiplying means provided on the second car which increases the and brake force of the second hand brake linkage to a level sufficient to apply the brakes on the second car through a second air brake linkage means located on the second car.

2. A hand brake assembly according to claim 1, wherein the force multiplying means increases the hand brake force to a level substantially equal to the originally applied hand brake force.

3. A hand brake assembly according to claim 1, wherein said force multiplying means is connected to a third hand brake linkage located on the second car linkage means; said third hand brake linkage means connected to a second force dividing means which divides the hand brake force coming from said force multiplying means into fourth and fifth hand brake linkage means.

4. A hand brake assembly according to claim 3, wherein said fourth hand brake linkage is connected to a second air brake linkage means to apply the hand brake force to the second car through second air brake linkage means.

5. A hand brake assembly according to claim 4, wherein said fifth hand brake linkage means extends to a third car to apply the hand brake force on the third car.

6. A hand brake assembly according to claim 5, wherein said fifth hand brake linkage means is connected to third force multiplying means provided on said third car which functions on the third to apply the hand brake force in said fifth hand brake linkage means to a lever sufficient to apply the hand brake force in the third car.

7. A hand brake assembly according to claim 4, wherein said fifth hand brake linkage is removably connected to the second car.

8. A hand brake assembly according to claim 1, including lever means located between said wheel assembly and said first force dividing means to adjust the applied hand brake force to a suitable brake application level, and which lever means avoid interference with structure on said first cars.

9. A hand brake assembly for use with separate railway cars or articulated car units comprising: a wheel assembly mounted adjacent one end of the first car; connecting said wheel assembly to a force dividing means provided on said first car which divides the applied hand brake force into the first and second hand brake linkages, each having a reduced hand brake force; said first hand brake linkage means connected to first air brake linkage means located on the first car at least partially within an air brake cylinder; whereby when said hand brake assembly is applied, said first hand brake linkage is effective to apply the brakes on the first car through said first air brake linkages; said second hand brake linkage extending from one car to a second adjacent car; means connecting said second hand brake linkage to a force multiplying means located on the second car which increases the hand brake force of the second hand brake linkage to a level sufficient to apply the brakes on the second car; third hand brake linkage means connecting said force multiplying means to a second force dividing means located on said second car; said second force dividing means connected to a fourth hand brake linkage means connected to second air brake linkage means; whereby to apply the brakes on said second car; said second force dividing means also connected to fifth hand brake linkage means extending longitudinally of the car.

10. A hand brake assembly according to claim 9, wherein said fifth hand brake linkage extends to a third car to apply the hand brake force on the third car.

11. A hand brake assembly according to claim 10, wherein said fifth hand brake linkage means is connected to a second force multiplying means provided on the third car which functions to apply the hand brake force in said fifth hand brake linkage means.

12. A hand brake assembly according to claim 9, wherein said fifth hand brake linkage means is removable connected to the second car.

13. A hand brake assembly according to claim 9, wherein said first air brake linkage means includes at least a portion located within an air brake cylinder.

14. A hand brake assembly according to claim 13, wherein said air brake linkage means is also at least partially located within an air brake cylinder.

15. A hand brake assembly according to claim 9, wherein said second force multiplying means increases the brake force to substantiate the originally applied hand brake force.

16. A hand brake arrangement according to claim 1, including chain means extending from said hand brake wheel to a horizontally extending lever pivotally mounted upon a car body.

17. A hand brake arrangement according to claim 16, wherein at the midpoint of said horizontally extending lever, a longitudinally extending brake rod is connected located between a wheel and other structure on the car bottom.

18. A hand brake arrangement according to claim 17, wherein said rod is connected to a second horizontally extending brake rod pivotally mounted on the car.

19. A hand brake arrangement according to claim 18, wherein said second horizontally extending brake lever is pivotally mounted on an opposite side than said first hand brake lever.

20. A hand brake system according to claim 19, wherein said first horizontally extending rod increases the hand brake force applied.

21. A hand brake arrangement according to claim 20, wherein said second horizontally extending brake lever reduces the applied hand brake force.

22. A hand brake arrangement according to claim 18, wherein said second hand brake lever is connected to a longitudinally extending rod which in turn is connected to said first force dividing means.

23. A hand brake arrangement according to claim 22, wherein connecting means are provided between said hand brake wheel and a longitudinally extending rod and wherein said longitudinally extending rod is connected to said sheave.

24. A hand brake arrangement according to claim 23, wherein said sheave includes a horizontally extending plate and said rod is connected to said plate by means of removable fasteners.

25. A hand brake arrangement according to claim 24, wherein said sheave is located within a protective enclosure longitudinally from the car.

26. A hand brake arrangement according to claim 25, wherein said protective closure includes a channel and a plate is welded to the upper portion of said channel.

27. A hand brake arrangement according to claim 1, wherein said force multiplying means comprises a chain and wherein said second hand brake linkage means comprises a rod extending between adjacent cars and wherein said rod is connected to said chain.

28. A hand brake arrangement according to claim 27, wherein said force multiplying means includes a horizontally extending plate and wherein said third hand brake linkage includes a rod having a first bifurcated end and wherein removable connecting means connect said plate to said bifurcated rod.

* * * * *